United States Patent [19]

Knyazeva et al.

[11] 4,259,854

[45] Apr. 7, 1981

[54] METHOD OF OBTAINING NATURAL LEATHER WITH HAIR FOR WARM UNLINED SHOES

[76] Inventors: Vera I. Knyazeva, ulitsa 50 let Sovetskoi Armii, 3-g; Nikolai V. Vasiliev, ulitsa 50 let Sovetskoi Armii, 36, kv. 7; Galina S. Khuditskaya, ulitsa Lermontova, 25/1, kv. 26; Alexandr I. Ponomarev, ulitsa 50 let Sovetskoi Armii, 34; Vasily I. Ponomarev, prospekt Lenina, 27, kv. 21; Oleg M. Belyansky, ulitsa 50 let Sovetskoi Armii, 3-v, all of Yakutsk, U.S.S.R.

[21] Appl. No.: 44,108

[22] Filed: May 31, 1979

[51] Int. Cl.[3] ..... C14B 1/00; C14C 11/00

[52] U.S. Cl. ..... 69/21; 69/22; 8/94.1 R; 8/94.13

[58] Field of Search ..... 69/21, 21.5, 22; 8/94.13, 94.1 R

[56] References Cited

U.S. PATENT DOCUMENTS

| | | | |
|---|---|---|---|
| 1,661,483 | 3/1928 | Laemmle | 66/22 |
| 1,788,026 | 1/1931 | Laskin | 69/22 |
| 2,204,262 | 6/1940 | Stern | 8/94.13 |
| 2,687,529 | 8/1954 | Keyser | 69/22 X |

FOREIGN PATENT DOCUMENTS

| | | | |
|---|---|---|---|
| 359480 | 10/1931 | United Kingdom | 69/22 |
| 692450 | 6/1953 | United Kingdom | 8/94.13 |

*Primary Examiner*—James Kee Chi

*Attorney, Agent, or Firm*—Holman & Stern

[57] ABSTRACT

The method of obtaining the leather resides in the treatment of cattle hides and includes the following successively performed operations: pretreating a raw hide, splitting it longitudinally to the thickness of 2.0 to 2.5 mm of the leather tissue, flushing the thus obtained grain split in an aqueous solution containing surface-active agents and ferments, pickling, tanning, shaving, greasing, drying, rolling, stretching and grinding. All the above operations are performed with the hair remaining on the unfinished leather.

As a result of the disclosed treatment there is obtained the leather with hair and with the suede finish of the flesh side. The leather is suitable for production of warm shoes, with the hair inside and no lining.

3 Claims, No Drawings

METHOD OF OBTAINING NATURAL LEATHER WITH HAIR FOR WARM UNLINED SHOES

BRIEF SUMMARY OF THE INVENTION

The invention relates to the leather production and, more particularly, it relates to a method of obtaining leather with hair, suitable for the manufacture of warm unlined footwear.

At present, warm footwear made from natural leather is usually manufactured with the incorporation of a lining. This is explained by the fact that all the hitherto known types of natural leather used for footwear manufacturing require either a warm interlay or an additional material for insulating the wearing person's foot from the unfinished flesh side of the leather. So far, the leather industry has not been manufacturing natural leather grades suitable for the manufacture of warm unlined footwear.

There is known a method of obtaining "suede" leather from cattle hides without retaining the hair used for the footwear manufacture, including pretreatment operations, liming, dehairing, deliming, tanning, splitting, shaving, greasing, drying, sawdusting or rolling, stretching, buffing or grinding, etc.

The leather grades obtained by this method cannot be used for the manufacture of warm footwear without providing the latter with a warm lining, which involves additional costs and labor consumption.

There is also known a method of obtaining leather with hair from cattle hides with the hair length up to 2 cm, suitable for the production of warm hair-out footwear, including pretreating a hide while retaining its hair, pickling, tanning, splitting to a 2.0 to 2.5 mm thickness, greasing with a grease mixture to the grease content in the leather body from 12 to 14 percent, drying to the moisture content within 18 to 22 percent, rolling, stretching, slight grinding of the flesh side to remove the weak or loose fibres of the leather tissue.

A disadvantage of this known method is that it does not provide for processing the finished leather with the hair length in excess of 2 cm; furthermore, the leather thus obtained cannot be made into footwear with the hair inside, i.e. hair-in footwear, on account of the flesh side presenting unsuitable appearance. Therefore, footwear is manufactured from leather thus obtained with the hair out, and with the mandatory incorporation of an internal lining.

OBJECT OF THE INVENTION

It is an object of the present invention to provide a method of treating hides obtained from cattle of the northern regions, i.e. the cattle having long hair, to produce leather with the hair retained and with the flesh side finished to the suede appearance, suitable for the manufacture of warm unlined footwear with the hair inside.

The essence of the herein disclosed method of obtaining leather from cattle hides, suitable for the manufacture of warm unlined footwear, resides in that all the operations of treating the unfinished leather are conducted while retaining the hair thereon.

In accordance with the invention, the disclosed method of obtaining leather with the hair retained includes pretreating raw leather obtained from cattle hides, splitting it longitudinally to the thickness of the leather tissue of the grain split within 2.0 to 2.5 mm, flushing the thus obtained grain split with an aqueous solution containing a surface-active agent and a ferment, pickling, tanning, shaving, greasing for introducing the grease into the leather body to a grease content within 3 to 5 percent by weight, drying, rolling, stretching, grinding, with all the abovementioned operations being conducted while retaining the hair on the unfinished leather.

In accordance with a feature of the present invention, it is expedient to use for flushing the grain split an aqueous solution containing by weight 0.3 to 0.5 percent the surface-active agent and 0.4 to 0.5 percent pancreatic ferment. The said solution has been found to render the leather tissue soft, and the hair fluffy.

In accordance with another feature of the present invention, it is expedient to use for greasing the unfinished leather a grease mixture containing 30 percent by weight emulsifier, 20 percent by weight the product of saponification of sulphonated vegetable oil with an alkali, 40 percent by weight sulphonated fat, 10 percent by weight fish oil. This composition has been found to render the leather water-repellent and elastic.

The herein disclosed method provides for obtaining the new type of natural leather of which one side retains the original hair, while the other side is suede-finished. The new type of leather is particularly suitable for the manufacture of new kinds of warm footwear where a warm lining is essentially the hair of the leather itself.

The use of thus obtained leather enables to reduce the cost and labor consumption associated with the manufacture of warm footwear.

The abovesaid and other advantages of the present invention will be made apparent in the detailed description of the invention, to follow hereinbelow.

DETAILED DESCRIPTION OF THE INVENTION

The initial raw material for obtaining natural leather suitable for the manufacture of warm unlined footwear are hides of cattle with the hair length of 2 cm and more.

The raw leather material, i.e. the hides are sorted into lots according to their weight, surface area leather body or tissue thickness, hair length, etc., and then are flushed with water and fleshed. The thus pretreated unfinished leather is subjected, with the hair retained, to longitudinal splitting with the object of reducing the thickness of the leather tissue of the grain split of the initial leather to 2 to 2.5 mm. The reduced thickness of the unfinished leather is required for ensuring the uniform distribution throughout the leather tissue of the components and chemicals used at the subsequent treatment stages, for reducing the consumption of these components and for speeding up the subsequent treatment operations. The thickness range between 2.0 to 2.5 mm is explained by the fact that with the unfinished leather split to a thickness substantially short of 2.0 mm, the roots of the hair might be undercut, whereas with the unifinished leather split to a thickness in excess of 2.5 mm, the process of footwear manufacture is complicated, and the weight of the footwear itself is increased, which is obviously undesirable. Following the splitting, the flesh-side layer is directed to be processed by the known methods as the flesh split, whereas the grain-split with the hair is flushed with an aqueous solution containing detergents and softening agents commonly used in the leather manufacture, such as surface-active agents and ferments. In this way the softness of the leather tissue and the fluffiness of the hair are attained. The flushed unfinished leather is then subjected to pickling with a solution of salts and acids, so as to prepare the fibres of the leather tissue to tanning, and to promote the fastness of the hair bulbs in the leather tissue. The pickled raw leather is air-seasoned for 20 to 24 hours to enhance the links between the introduced agents and the fibres of the leather tissue, and then it is squeezed to reduce the water content to 50 . . . 55%, whereafter the unfinished leather is tanned.

The tanning may be conducted with any suitable known per se tanning agent, e.g. chromium oxide. In this case the tanning is conducted with the chromium oxide solution at 25 ... 28° C. for 12 to 14 hours, whereafter the unfinished leather is air-seasoned once again for 8 to 10 hours and squeezed to reduce the moisture content to 50 . . . 55%.

Then the semi-finished material is subjected to shaving to remove the irregularities of its thickness, whereafter it is neutralized with an aqueous solution of sodium bicarbonate at 30° to 40° C. for 30 to 60 minutes. If required, following the neutralization, the semi-finished product is dyed to a specified colour while being submerged in a solution of a dye and a dispersion agent, whereafter the product is water-flushed for 20 to 30 minutes at a temperature of 45° to 55° C.

The flushed product is then subjected to greasing including treating the product with a grease mixture of a type commonly used in the leather production, e.g. a mixture containing by weight 30% emulsifier, 20% the product of saponification of sulphonated vegetable oil with an alkali, 40% sulphonated fat, 10% fish oil. The emulsifier in most cases is the product of saponification of synthetic fatty acids. The amount of the grease mixture introduced into the semifinished product is preferably 3 to 5% by weight. With the amount of the introduced grease short of 3%, the water-repellent properties of the product have been found inadequate, whereas with the amount in excess of 5%, the flesh side of the leather becomes greasy when ground or buffed to attain the suede finish. If the leather had been dyed, following the greasing, it is treated with a solution of acetic acid to fasten the dye. In any case, following the greasing, the semi-finished leather is flushed with water for 15 to 30 minutes, squeezed and directed to drying. The drying is conducted to reduce the moisture content to 18 . . . 20%.

The dried semi-finished product is subjected to rolling in a drum to soften the leather, and to staking in a staking machine and stretching on a stretcher frame.

The flesh side of the thus obtained semi-finished leather product is ground or buffed twice: the first grinding or buffing is performed with an abrasive material with coarse grain, and the second grinding or buffing is performed with a fine-grain abrasive material. Following the grinding or buffing, the product is subject to dedusting, which yields the finished leather.

The herein disclosed method, as it has been explained, yields the novel type of leather retaining the original hair.

Following all the abovedescribed treatment, the hair would not loose its original properties. On the contrary, the treatment with the detergents and softening agents renders the hair clean, fluffy and strong, whereas the flesh side of the leather has uniform velvet-like appearance, providing for the elegant outlook of the footwear made therefrom.

The disclosed method is suitable for treating cattle hides with the hair length as great as 10 cm: the longer the hair, the warmer is the footwear manufactured from the leather obtained by the method.

For the present invention to be better understood, given hereinbelow is an example of the implementation of the method in the leather production.

EXAMPLE

Cattle hides are classified into lots by the similarity of the preservation method, the weight, the thickness, the surface area, the hair length, the absence of bald and loose hair spots.

A lot of the raw material (young bull hides, 6 cm hair length, green-salted) weighing 1,000 kg is loaded into a drum and flushed for one hour with running water at a temperature of 16° to 22° C. Following the flushing, the raw product is subjected to fleshing and edge-trimming, whereafter it is loaded for soaking into a drum containing 2,000 liters of water at 16° . . . 22° C. The soaking is performed to recondition the raw material to its initial or raw state. Without dehairing the hides, they are fed into a splitting machine, to be longitudinally split to the thickness of the grain split from 2.0 to 2.5 mm. The flesh split is then directed to further treatment according to any suitable known per se method of leather production.

The grain split with the hair retained thereon is loaded into a drum containing 2,000 liters of a solution containing 10 kg sodium chloride, 3 kg sulphanol, and pancreatic ferment obtained by extracting 4 kg of pancreas with an ammonium sulphate solution for one hour. The split is treated in this solution in the rotating drum for 1.5 to 2.0 hours, with the solution temperature from 30° C. to 35° C. With the treatment completed, the splits are unloaded from the drum, stacked and kept in air for 15 to 20 minutes. Then the air-conditioned product is loaded into a drum for pickling, with the drum being filled with 2,000 liters of an aqueous solution containing 150 kg sodium chloride, and the drum with the product therein is rotated for 35 minutes, whereafter 20 kg sulphuric acid is added into the drum, and the drum is rotated for 9 hours more, the solution temperature being maintained at 22° . . . 26° C. With the nine-hour treatment completed, the product is unloaded from the drum, the pieces are stacked and air-conditioned for 22 hours, whereafter they are subjected to squeezing with the aim of reducing the moisture content to 50 . . . 55%. The squeezed product is loaded into a tanning drum containing 2,000 liters of an aqueous solution of chromium oxide. The chromium oxide is fed -in in three portions, 10 kg each, with 30-minute intervals. After 6 . . . 8 hours of the treatment, 30 kg of sodium sulphate are added in three 10 kg portions, with 15-minute intervals. Four hours after the introduction of the sodium sulphate, 3 kg of soda ash are added in three 1 kg portions, with 15-minute intervals. The tanning process is conducted with the solution temperature maintained at 25° . . . 28° C. Following 12 . . . 14 hours of the treatment, the tanned product is unloaded from the drum, and individual pieces are stacked so that no wrinkles and creases are left, to be air-conditioned for 9 hours and then squeezed to the moisture content of 50 . . . 55%. The squeezed product is subjected to the shaving of the flesh side to remove all the irregularities, whereafter the product is loaded into a drum to be neutralized in 2,000 liters of a solution containing 25 kg sodium bicarbonate, for 60 minutes. The temperature of the neutralizing solution is maintained at 30° . . . 35° C. Following the neutralization, the product is flushed with running water at 40° . . . 50° C. for 3 minutes.

If required, the product is then subject to dyeing with any known per se suitable dye, with the subsequent flushing of the product and fastening of the dye with acetic acid.

Following the flushing, the semi-finished product is greased in a drum with a greasing mixture containing 30% emulsifier, 20% the product of saponification of sulphonated vegetable oil with an alkali, 40% sulphonated fat, 10% fish oil, the object being to introduce the grease into the leather tissue in an amount of 4% by weight.

The greasing is conducted at a temperature of 50° to 55° C. for 60 minutes, whereafter the semi-finished leather pieces are unloaded from the drum, stacked grain-to-grain, i.e. hair-to-hair and air-conditioned for 4 hours, whereafter they are squeezed to reduce the moisture content to 50 . . . 55%. The squeezed semi-finished leather is then put into a drying chamber with the air temperature of 45° to 50° C. The semi-finished product is dried therein to the moisture content of 18 to 22%, whereafter it is air-conditioned for 24 hours, slightly moistened and loaded into a rolling drum to be treated therein for 10 hours. The leather thus obtained is staked in a staking machine and then stretched and fixed with simultaneous after-drying to a 14 . . . 16% moisture content. The staked and stretched pieces of leather are then ground or buffed twice, first, with a coarse-grain abrasive-coated cloth, then, with a fine-grain one.

The ground or buffed leather pieces are dedusted, and thus the leather attains its final marketable form: with the grain side covered with the clean fluffy hair, and the flesh side having a smooth velvet-like appearance over its entire surface.

The herein disclosed method is suitable for the treatment of cattle hides with any hair length; however, the most suitable hides are those with the hair length in excess of 2 cm, since the leather obtained will render the footwear made therefrom warmer.

What is claimed is:

1. A method of obtaining natural leather with hair, particularly suitable for the manufacture of warm unlined footwear, including the following successively performed operations: pretreating cattle hides into an unfinished leather product; splitting said product longitudinally to the thickness of the leather tissue of the grain-side layer within 2.0 to 2.5 mm; flushing the thus obtained grain split unfinished leather product with an aqueous solution containing a surface-active agent and a ferment; pickling; tanning; shaving; greasing said product so that it absorbs 3 to 5 percent grease by weight; drying; rolling; stretching; and grinding; all said operations of treating the unfinshed leather being conducted with the hair retained thereon.

2. A method as set forth in claim 1, wherein the flushing of the grain split is conducted with a solution containing by weight 0.3 to 0.4 percent surface-active agent and 0.4 to 0.5 percent pancreatic ferment.

3. A method as set forth in claim 1, wherein the greasing is conducted with a grease mixture containing by weight substantially 30 percent emulsifier, 20 percent product of saponification of sulphonated vegetable oil with an alkali, 40 percent sulphonated fat, 10 percent fish oil.

* * * * *